US008333238B2

(12) United States Patent
Rodgers

(10) Patent No.: US 8,333,238 B2
(45) Date of Patent: Dec. 18, 2012

(54) COMPACT SNUBBING UNIT

(75) Inventor: Troy A. Rodgers, Chickasha, OK (US)

(73) Assignee: Rodgers Technology, L.L.C., Chickasha, OK (US)

( * ) Notice: Subject to any disclaimer, the term of this patent is extended or adjusted under 35 U.S.C. 154(b) by 147 days.

(21) Appl. No.: 12/718,742

(22) Filed: Mar. 5, 2010

(65) Prior Publication Data

US 2010/0224357 A1 Sep. 9, 2010

Related U.S. Application Data

(60) Provisional application No. 61/157,731, filed on Mar. 5, 2009.

(51) Int. Cl.
*E21B 19/22* (2006.01)

(52) U.S. Cl. ..... 166/77.1; 166/77.4

(58) Field of Classification Search ..... 166/77.1, 166/77.2, 77.4, 75.14, 380, 381
See application file for complete search history.

(56) References Cited

U.S. PATENT DOCUMENTS 2,200,075 A * 5/1940 Caldwell ..... 173/44
3,797,570 A 3/1974 Leutwyler
4,085,796 A 4/1978 Council
6,158,516 A 12/2000 Smith et al.
6,386,284 B1 5/2002 Buck et al.
6,688,393 B2 2/2004 Sredensek et al.
2006/0043349 A1 3/2006 Smith
2006/0118294 A1 6/2006 Haakenson
2007/0193749 A1 * 8/2007 Folk ..... 166/379

OTHER PUBLICATIONS

International Search Report and Written Opinion (PCT/US2010/026412); Jun. 22, 2010.
International Preliminary Report on Patentability (PCT/US2010/026412); Sep. 15, 2011.

* cited by examiner

*Primary Examiner* — Kenneth L Thompson
*Assistant Examiner* — Ronald Runyan
(74) *Attorney, Agent, or Firm* — Dunlap Codding, P.C.

(57) ABSTRACT

A snubbing apparatus for moving well tubing through a blowout preventer including a support frame, a standing tubular engaging assembly, a pair of linear actuators, and a traveling tubular engaging assembly. The actuators have a cylinder and a rod, and the cylinder has an upper end and a lower end. The cylinders are connected to the support frame in a diametrically opposing relationship to one another and with the lower ends of the cylinders extending downwardly beyond the lower end of the support frame and spaced apart from one another a distance sufficient so that the lower ends of the cylinders are positioned on opposing sides of the blowout preventer when the support frame is connected to the blowout preventer.

6 Claims, 4 Drawing Sheets

COMPACT SNUBBING UNIT

CROSS REFERENCE TO RELATED APPLICATIONS

This application claims benefit to U.S. Provisional Application No. 61/157,731, filed Mar. 5, 2009, of which the entire contents are hereby incorporated herein by reference.

BACKGROUND OF THE INVENTION

1. Field of the Invention

This invention relates to well tubing handling systems, and more particularly, but not by way of limitation, to a snubbing apparatus used for running and pulling well tubing through a wellhead under pressure.

2. Brief Description of Related Art

Well tubing handling systems employed in running and pulling well tubing under pressure, particularly, for well workover operations, have been known for many years. Such well tubing handling systems are commonly known as "snubbing units." It is common practice to use cable and pulley arrangements and hydraulic cylinders, both alone and in combination, for lifting well tubing from a well and for pushing the well tubing downwardly into the well against well pressure. Some such systems are mounted on and supported solely from the wellhead structures, while others involve the use of substantial platform structures, including derrick type frameworks.

An important factor in the operation of well snubbing units is the cost of servicing a well with the apparatus. Such cost is often directly related to the length of time the well is shut down and, thus, not producing an income, and the length of time the well is shut down directly corresponds to how long the snubbing operation takes. Many factors dictate how long a snubbing operation will last. One of these factors includes the depth of the well. However, other factors directly related to the snubbing apparatus include the length of its stroke and its lifting capacity. Clearly, a snubbing apparatus with a short stroke length will require a greater number of cycles to run or pull a given length of well tubing.

Another factor in the operation of well snubbing apparatus is getting the apparatus to the well site. Many wells have been drilled in environmentally sensitive areas not easily accessible by land vehicle. For example, many wells have been drilled in offshore locations or in swamp lands. Prior art snubbing apparatus are typically trailer mounted eliminating the ability to operate in offshore or swampy areas. For snubbing apparatus that might be sized to be transported by water vehicles, a downsized version may be a limiting factor with respect to the length of the stroke of the device and the amount of weight the unit can lift, thereby increasing the cost of operating such a snubbing apparatus.

To this end, a need exists for a compact snubbing apparatus that is capable of being mounted to a vehicle which is capable of accessing wet areas, such as a barge or swamp buggy, while not sacrificing power or stroke length. It is to such a snubbing apparatus that the present invention is directed.

DETAILED DESCRIPTION OF EXEMPLARY EMBODIMENTS

Figure 1:
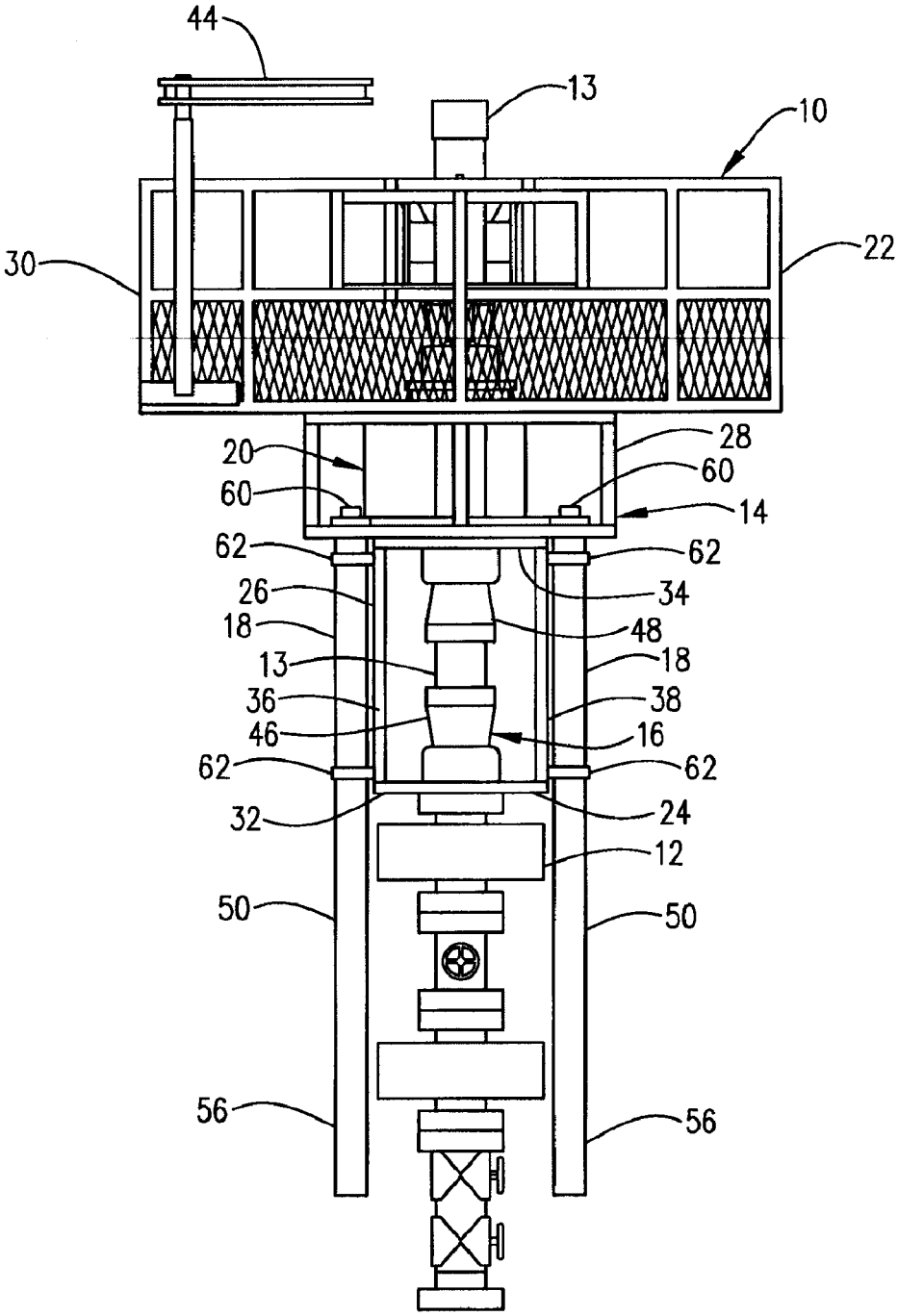
FIG. 1 is an elevational view of a snubbing apparatus constructed in accordance with the present invention shown connected to a blowout preventer and in a retracted condition.
Figure 2:
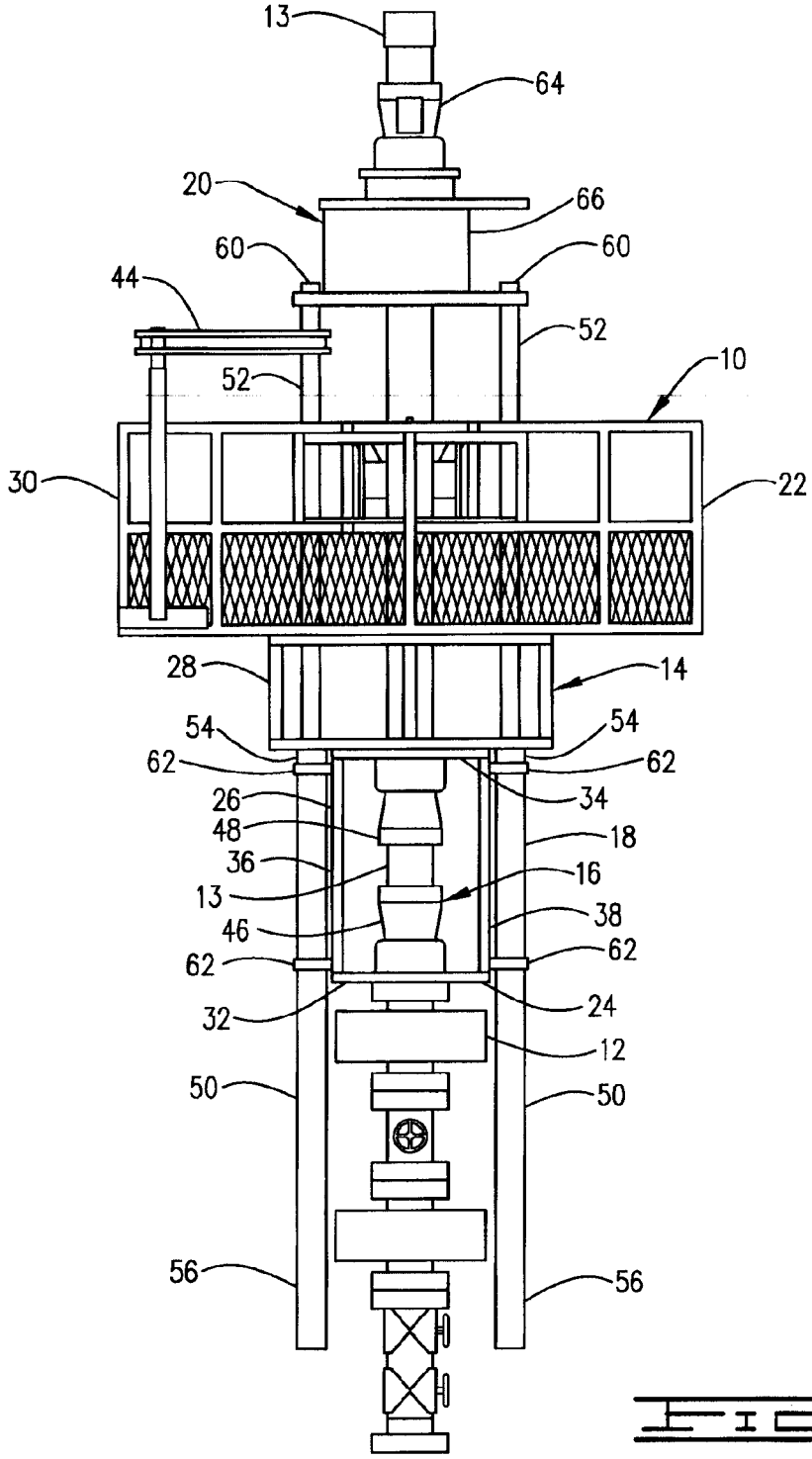
FIG. 2 is an elevational view of the snubbing apparatus of FIG. 1 shown in an extended condition.

Referring now to the drawings, and more particularly to FIGS. 1 and 2, a snubbing apparatus 10 embodying the features of the present invention is shown mounted on a well having a head provided with a blowout preventer 12. The snubbing apparatus 10 is adapted to run and pull a string of well tubing, such as well tubing 13, through the blowout preventer 12. The blowout preventer 12 may be any suitable blowout preventer, such as the type that includes an internal bag arrangement which may be pressurized to close around a well tubing passing through the blowout preventer for preventing leakage along the tubing as the tubing is inserted into and pulled from a well. Preferably, the blowout preventer 12 is mounted on additional conventional ram-type blowout preventers supported on a master valve mounted on the wellhead which is secured on the upper end of the well casing, all of which are conventional wellhead and safety components which, for purposes of brevity, are not described herein.

The snubbing apparatus 10 includes a support frame 14, a standing tubular engaging assembly 16, a pair of actuators 18, and a traveling tubular engaging assembly 20. The support frame 14 is characterized as having an upper end 22 and a lower end 24 with the lower end 24 being connectable to the blowout preventer 12. More particularly, the support frame 14 has a slip frame 26, an auxiliary frame 28, and a work platform or basket 30.

The slip frame 26 generally includes a bottom plate 32, a top plate 34, and two side plates 36 and 38, all interconnected with one another to form a substantially square or rectangular box structure. The bottom plate 32 and the top plate 34 are each provided with an opening (not shown) which are axially aligned with one another to receive the well tubing there through. The bottom plate 32 defines the lower end 24 of the support frame 14 and is adapted to be connected to the upper end of the blowout preventer 12 with suitable fasteners, such as nut and bolt combinations.

Figure 4:
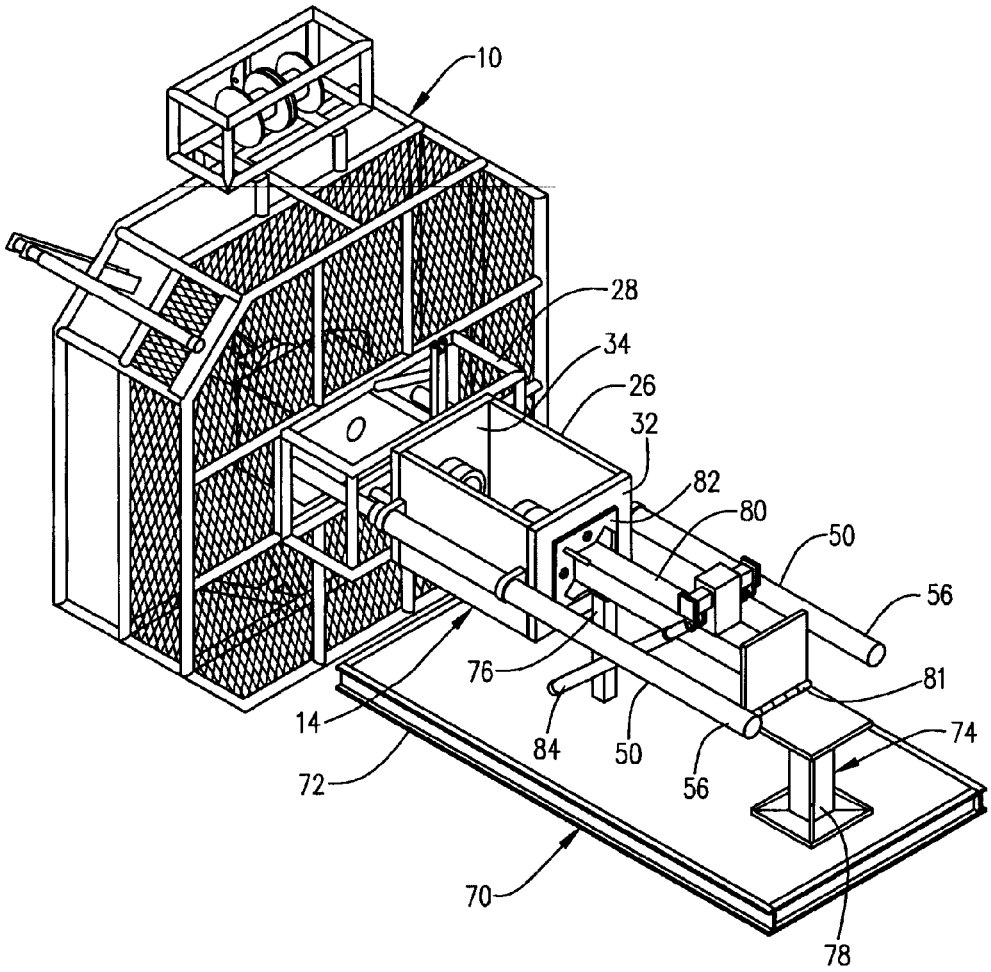
FIG. 4 is a perspective view of the snubbing apparatus of FIG. 3, shown in a down position.

The auxiliary frame 28, as best shown in FIG. 4, is an open sided and open ended rectangular structure connected to the top plate 34 of the slip frame 26. The auxiliary frame 28 serves to support the work platform 30 in a vertically spaced relationship above the top plate 34 of the slip frame 26. The auxiliary frame 28 is preferably dimensioned such that the traveling tubular engaging assembly 20 is substantially received within the auxiliary frame 28 (FIG. 1) when the actuators 18 are in a retracted position as will be described in more detail below. In addition, the auxiliary frame 28 provides access for the actuators 18 to extend from the slip frame 26 to a position above the work platform 30 in a manner also to be discussed below.

The work platform 30 is mounted on an upper end of the auxiliary frame 28 to support workers and ancillary equipment, such as a control console (not shown), a winch 44, and a gin pole (not shown).

The standing tubular engaging assembly 16 is shown herein to include a lower slip bowl assembly 46 connected to the lower plate 32 of the slip frame 26 and an upper slip bowl assembly 48 connected to the upper plate 34 of the slip frame 26. The lower slip bowl assembly 46 and the upper slip bowl assembly 48 may be any suitable mechanism for selectively gripping and releasing well tubing. In general, the slip bowl assemblies will comprise an annular slip bowl having an inclined surface. A plurality of slip jaws will have a complimentary inclined surface which slides down the inclined surface allowing teeth on slip jaws to engage the well tubing. When the slip jaws are set, it will be readily apparent that the weight of the well tubular pulling the slip jaw downward will cause the slip jaw to grip the well tubular with greater axial force. To release the well tubular, its weight is removed from the slip jaws and the slip jaws are pulled from contact with the well tubular. Slip bowl assemblies as briefly described above are well known in the art. Thus, no further description of their components, construction, or operation is believed necessary in order for one skilled in the art to understand and implement the apparatus of the present invention.

The actuators 18 are shown to be conventional hydraulic piston and cylinder assemblies comprising a cylinder 50 and a rod 52. Each of the cylinders 50 is characterized as having an upper end 54 and a lower end 56, and the rod 52 is characterized as having a proximal end which is contained within the cylinder 50 and thus is not shown, and a distal end 60. The rod 52 extends from the upper end 54 of the cylinder 50 and is operable between a retracted condition (FIG. 1) and an extended condition (FIG. 2). The actuators 18 may be any conventional hydraulic piston and cylinder assembly. Hoses and other details concerning the flow of hydraulic fluid in the cylinders are not shown because the operation of hydraulic cylinders is believed to be well known in the art. Moreover, it should be appreciated that many other types of actuator assemblies may be used in place of hydraulic cylinders, and those are intended to be included within the scope of the present invention. Further, while the cylinder and piston assemblies will generally be discussed herein as being hydraulically operated, it will be understood that pneumatic assemblies could also be employed.

The cylinders 50 are connected to the side plates 36 and 38 of the slip frame 26 in a diametrically opposed relationship to one another. To reduce the profile of the snubbing apparatus 10, the cylinders 50 are connected to the side plates 36 and 38 such that the lower ends 56 of the cylinders 50 extend downwardly beyond the bottom plate 32 of the slip frame 26. To this end, as shown in FIGS. 1 and 2, the cylinders 50 are spaced apart from one another a distance sufficient so that the lower ends 56 of the cylinders 50 are positionable on opposing sides of the blowout preventer 12 when the support frame 14 is connected to the blowout preventer 12. It will be appreciated that the distance beyond the lower plate 32 which the cylinders 50 extend may be varied, and may depend on such variables as the dimensions of the slip frame 26 and the length of the cylinders 50. In the end, the only limiting factor with respect to how far beyond the lower plate 32 of the slip frame 26 that the cylinders may extend is that the lower end 56 of the cylinders should be spaced above the ground support surface to permit the snubbing apparatus 10 to be erected in a substantially vertical orientation. The cylinders 50 are connected to the side plates 36 and 38 with connectors 62. The connectors 62 may be any suitable connector for securing the cylinders 50 to the side plates 36 and 38; however, it is preferable that the connectors 62 be detachable from the side plates 36 and 38 such that the cylinders 50 may be detached from the side plates 36 and 38 to allow for the actuators 18 to be removed and replaced with actuators of a different size, as desired.

The traveling tubular engaging assembly 20 is connected to the distal end 60 of the rods 52 and is operable between a tubular engaging condition and a tubular release condition. In general, the traveling tubular engaging assembly 20 includes a slip bowl assembly 64 connected to a rotary table 66. Like the upper and lower slip bowl assemblies 46 and 48 described above, the slip bowl assembly 64 and the rotary table 66 are well known in the art. Thus, no further description of their components, construction, or operation is believed necessary in order for one skilled in the art to understand and implement the apparatus of the present invention.

In use, the snubbing apparatus 10 is connected to the blowout preventer 12 such that the lower ends 54 of the cylinders 50 are positioned on opposing sides of the blowout preventer 12. It will be appreciated that the snubbing apparatus 10 is positioned on the blowout preventer 12 with a suitable device, such as a crane (not shown) which would be provided at the well site. To run well tubing, such as well tubing 13, into the well, each length of tubing is raised to a position above the standing tubular engaging assembly 16 and lowered downwardly through the slip bowl assembly 64 and the rotary table 66. The actuators 18 are extended thereby raising the traveling tubular engaging assembly 16 to grip the tubing 13 (FIG. 2) near its upper end thereof. The traveling tubular engaging assembly 20 is then lowered by retracting the rods 52 so as to force the tubing 13 downwardly through the upper slip bowl assembly 48, the lower slip bowl assembly 46, through the blowout preventer 12 into the wellbore. When the actuators 18 are fully retracted, one of the upper slip bowl assembly 48 and the lower slip bowl assembly 46 is activated to grip the tubing 13 to hold the tubing either against the weight of gravity or against the well pressure depending upon operating conditions while the traveling tubular engaging assembly 20 is released from the tubing 13 and raised to grip and force another increment of the tubing string downwardly. The length of each increment of tubing depends upon the amount of extension provided in the actuators. A plurality of lengths of tubing are connected in a conventional manner as the tubing string is made up and forced downwardly by the snubbing apparatus 10.

In pulling a tubing string from a wellbore, the tubing string is sequentially engaged by the traveling tubular engaging assembly 20 when the actuators 18 are in a retracted position and the traveling tubular engaging assembly 20 is then raised by the actuators 18 to lift the tubing string. During the retracted cycle of the actuators, the appropriate lower and upper slip bowl assemblies 46 and 48 are engaged with the tubing to hold it while the traveling tubular engaging assembly 20 moves from the extended position to a retracted position to re-engage and lift the tubing string.

Figure 3:
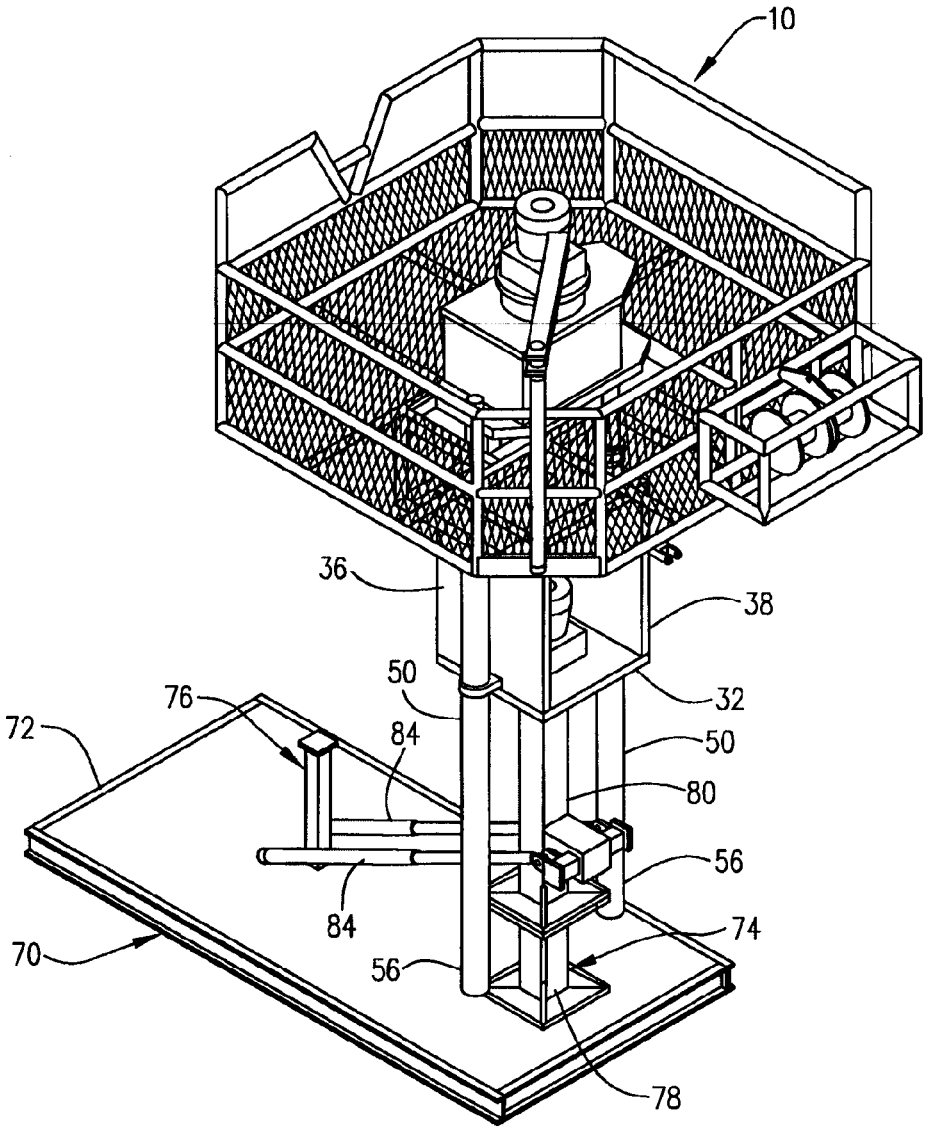
FIG. 3 is a perspective view of the snubbing apparatus of the present invention shown mounted to a lay down assembly and in an up position.

Referring now to FIGS. 3 and 4, the snubbing apparatus 10 further includes a laydown assembly 70. The laydown assembly 70 serves to transport the portion of the snubbing apparatus 10 previously described. The laydown assembly 70 includes a skid or base platform 72, a first pedestal assembly 74, and a second pedestal assembly 76. The base platform 72 is generally a skid with an upper surface capable of supporting the snubbing apparatus 10.

The first pedestal assembly 74 includes a first rigid portion 78 connected to the base platform 72 and extending upwardly therefrom. The first pedestal assembly 74 further includes a second rigid portion 80 which is pivotally connected to the first rigid portion with a hinge 81 (FIG. 4). The second rigid portion 80 has an upper flanged end 82 (FIG. 4) that is connectable to the lower plate 32 of the slip frame 26 when the snubbing apparatus 10 is disconnected from the blowout preventer 12. The first rigid portion 78 and the second rigid portion 80 have a combined length such that the lower ends 56 of the cylinders 50 are vertically spaced from the base platform 72 when the lower plate 32 of the support frame 14 is connected to the flanged upper end of the second rigid portion 80.

The second rigid portion 80 is moveable between a first or up position (FIG. 3) wherein the second rigid portion 80 is axially aligned with the first rigid portion 78 and a second or down position (FIG. 4) wherein the second rigid portion 80 is angularly positioned relative to the first rigid portion 78. The laydown assembly 70 further includes a pair of actuators 84 for moving the second rigid portion 80, along with the snubbing apparatus 10, between the first position and the second position. The actuators 84 are pivotally connected at one end to the base platform 72 and pivotally connected at the other end to the second rigid portion 80 of the first pedestal assembly 74.

The second pedestal assembly 76 is connected to the base platform 72 and is positioned to engage and support the second rigid portion 78 when the second rigid portion 80 is in the second position, as shown in FIG. 4.

It will be appreciated by those of ordinary skill in the art that the snubbing apparatus 10 described herein will generally be hydraulically operated. To this end, the snubbing apparatus 10 will require hydraulic power and control fluids system for operating the snubbing apparatus 10. Hydraulic power and control systems are well known in the art. Thus, no further description of their components, construction, or operation is believed necessary in order for one skilled in the art to understand and implement the apparatus of the present invention.

From the above description, it is clear that the present inventive concept is well adapted to carry out the objects and to attain the advantages mentioned herein as well as those inherent in the invention. While a presently preferred embodiment of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A snubbing apparatus for moving well tubing through a blowout preventer, comprising:

a support frame having an upper end and a lower end, the lower end being connectable to the blowout preventer;

at least one standing tubular engaging assembly connected to the support frame, the standing tubular engaging assembly being operable between a tubular engaging condition and a tubular release condition;

at least two linear actuators, each actuator having a cylinder and a rod, the cylinder having an upper end and a lower end, and the rod having a proximal end and a distal end, the rod extending from the upper end of the cylinder and being operable between a retracted condition and an extended condition, the cylinders connected to the support frame in a diametrically opposing relationship to one another and with the lower ends of the cylinders extending downwardly beyond the lower end of the support frame and spaced apart from one another a distance sufficient so that the lower ends of the cylinders are positioned on opposing sides of the blowout preventer when the support frame is connected to the blowout preventer; and a traveling tubular engaging assembly connected to the distal end of the rods, the traveling tubular engaging assembly being operable between a tubular engaging condition and a tubular release condition, wherein the support frame further comprises a slip frame including a bottom plate, a top plate, and at least two side plates, the bottom plate and the top plate each having an opening axially aligned with the other opening to receive the well tubing therethrough, the bottom plate defining the lower end of the support frame, the standing tubular engaging assembly being connected to at least one of the bottom plate and the top plate and about the opening of the respective top and bottom plate.

2. The snubbing apparatus of claim 1, wherein the standing tubular engaging assembly includes a first slip bowl assembly connected to the bottom plate and a second slip bowl assembly connected to the top plate in an opposing relationship.

3. The snubbing apparatus of claim 1 wherein the cylinders are connected to the side plates of the slip frame.

4. The snubbing apparatus of claim 1 wherein the support frame further comprises a work platform vertically spaced above the upper plate of the slip frame, the work platform being spaced from the top plate a distance such that the traveling tubular engaging assembly is substantially received between the top plate and the work platform when the rods are in the retracted position.

5. The snubbing apparatus of claim 1 further comprising:

a laydown assembly comprising:

a base platform;

a pedestal assembly having a first rigid portion connected to the platform and extending upwardly therefrom and a second rigid portion pivotally connected to the first portion, the second rigid portion having an upper end connectable to the lower end of the support frame when the support frame is disconnected from the blowout preventer, the first rigid portion and the second rigid portion having a combined length such that the lower ends of the cylinders are vertically spaced from the base platform when the lower end of the support frame is connected to the upper end of the second rigid portion, the second rigid portion being movable between a first position wherein the second rigid portion is axially aligned with the first rigid portion and the support frame is in a substantially vertical orientation and a second position wherein the second rigid portion is angularly positioned relative to the first rigid portion and the support frame is in a substantially prone position; and means for moving the second rigid portion between the first position and the second position.

6. The snubbing apparatus of claim 5 wherein the laydown assembly further comprises a second pedestal assembly connected to the base platform and positioned to engage the second rigid portion when the second rigid portion is in the second position.

* * * * *